United States Patent [19]

Oberle

[11] 4,114,651

[45] Sep. 19, 1978

[54] COMBINED STOP AND CONTROL VALVE

[75] Inventor: Arthur Oberle, Ennetbaden, Switzerland

[73] Assignee: BBC Brown Boveri & Company Limited, Baden, Switzerland

[21] Appl. No.: 679,463

[22] Filed: Apr. 22, 1976

[30] Foreign Application Priority Data

Apr. 30, 1975 [CH] Switzerland ..... 5563/75

[51] Int. Cl.[2] ..... F16K 1/00

[52] U.S. Cl. ..... 137/630.14; 137/613; 137/630.15

[58] Field of Search ..... 137/613, 630, 630.11, 137/630.13–630.15, 630.22; 251/38, 39, 25

[56] References Cited

U.S. PATENT DOCUMENTS

| | | | |
|---|---|---|---|
| 2,795,391 | 6/1957 | Krone et al. | 251/38 |
| 3,809,126 | 5/1974 | Oberle | 137/630.15 X |

*Primary Examiner*—Martin P. Schwadron
*Assistant Examiner*—Richard Gerard
*Attorney, Agent, or Firm*—Burns, Doane, Swecker & Mathis

[57] ABSTRACT

A combined stop and control valve for incorporation into a pipe carrying the working medium of a turbomachine and in particular a steam turbine has the respective bodies of the stop and control valves arranged independently of each other in a common housing which is provided with co-axially arranged valve seats located adjacent one another at the flow opening of the valve. The body of the stop valve has a bell-shaped configuration into the hollow cavity of which the body of the control valve is inserted. Axial guides are provided for the stop and control valve bodies and the stop valve is situated ahead of the control valve when viewed in the flow direction.

3 Claims, 1 Drawing Figure

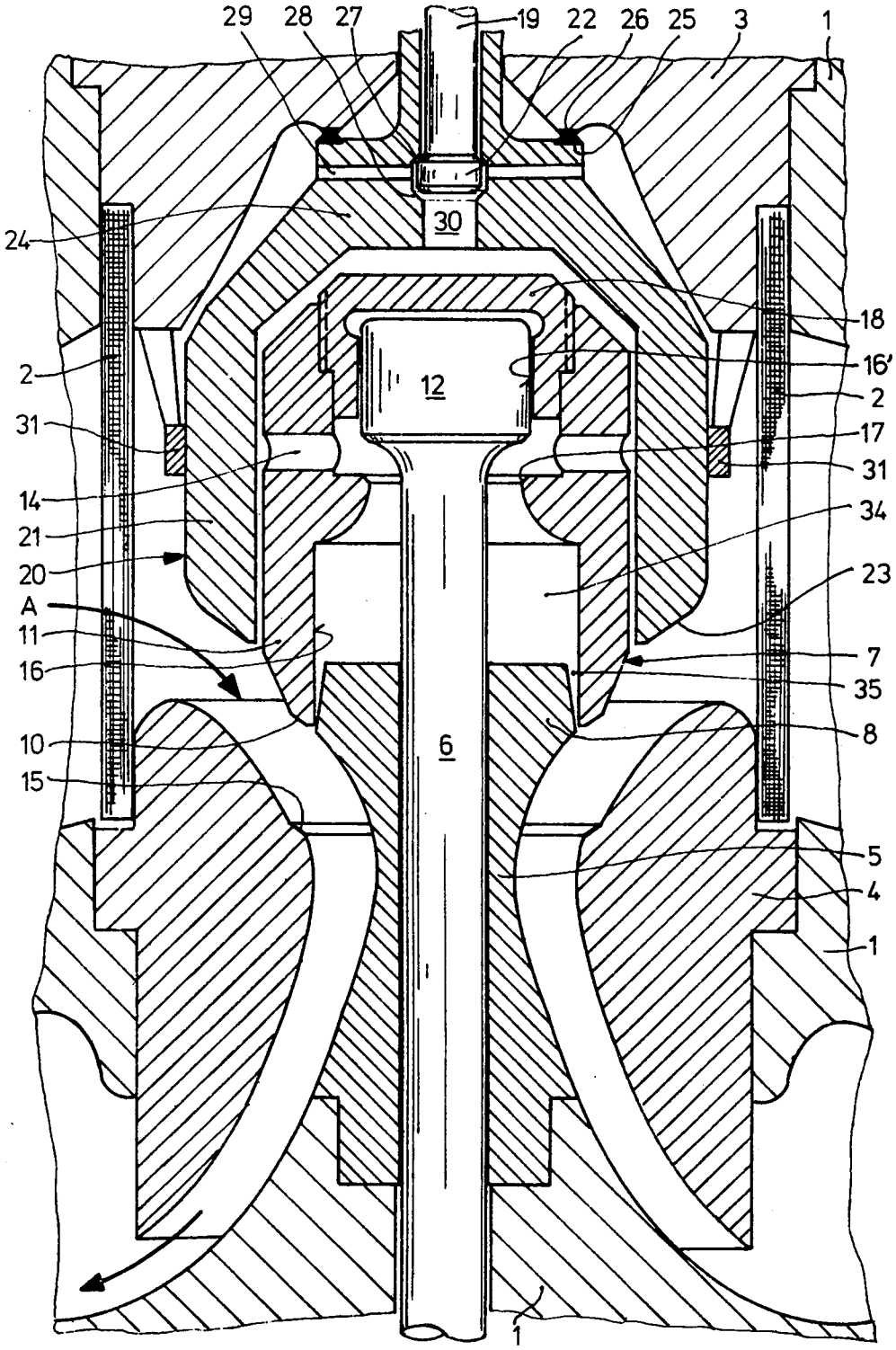
29
28
27
19
22
26
25
3
1
30
24
18
16'
2
12
2
31
17
31
14
34
21
20
23
A
11
7
16
35
10
8
6
15
5
4
1
1

COMBINED STOP AND CONTROL VALVE

The invention concerns a combined stop and control valve for mounting in the pipes carrying the working medium of turbo-machines of which the stop valve body and control valve body are arranged independently of each other in a common valve housing, the valve bodies being provided with coaxial valve seats located next to each other and immediately at a flow opening.

In general, the control valves fitted in the pipe carrying the working medium of turbines, in particular steam turbines, are always coupled with fast-acting stop valves so that at least a high-speed shutdown can be carried out in the event of a control failure or in response to any external influences, thus maintaining the principle of duplicated safety for the whole power installation. It has also for a long time been customary to fit interceptor valves in the reheat line of steam turbines with reheaters, as otherwise the volume of steam present in the reheater and in the connecting pipe would be sufficient following a shutdown, even with the high-pressure line closed, to accelerate the turbine to an unacceptably high overspeed which would endanger not only the turbine, but also the whole power installation. To prevent this effect, therefore, interceptor valves are incorporated in the reheat line before the inlet to the section of the turbine connected after the reheater.

Interceptor valves are known which do not consist of two separate valve housings, but whose control valve and stop valve are contained in a common valve housing. In such cases, advantage is taken of the reduced flow resistance due to a common valve seat for the stop section and control section.

In a known construction, the control valve body is in the form of a bell in the hollow cavity of which the plate-shaped stop valve body travels during the opening movement. The valves are then preferably so connected that in their end positions the two valve bodies are in the same position relative to one another.

During the course of power plant development it was reasonable with large steam volumes to employ this form of valve also for live steam control valves. The bell-shaped control valve then serves to modify the performance of the steam turbine in response to load variations.

It has been found, however, that with prolonged partload operation, i.e. with the control valve in a throttled position, this form of valve has a tendency to vibrate, giving rise to damage due to wear and cyclic stresses.

The general object of the invention is to avoid the disadvantages stated above.

This object is achieved in that the stop valve body is in the form of a bell into the hollow cavity of which the control valve body is coaxially inserted, both the stop valve body and the control valve body being provided with an axial guide, and the stop valve is situated ahead of the control valve when viewed in the flow direction.

In a preferred alternative form of the invention both the control valve body and the stop valve body are each provided with a pilot valve, the control valve body being guided axially by the spindle head, which takes the form of the pilot valve, and also by a guide bush or sleeve the outer contour of which, together with the valve seat, forms an annular diffusor. It is of particular advantage if a guiding gap runs conically between the guide bush and the valve body in the flow direction in order to ensure hydrodynamic centering of the valve body.

The advantage of the invention is to be seen in the fact that with the stop valve ahead of the control valve, viewed in the flow direction, vibration-free location of the valve body is achieved by the full pressure difference between live steam and atmosphere in the open position. Furthermore, the valve body is no longer subjected to the throttled mass flow jet of the control valve during operation, thus eliminating a further source of vibration.

The control valve, on the other hand, has double axial guidance at every control setting, this guidance being aided during operation by the dynamic centering effect of the stream of working medium flowing over the pilot valve.

A further advantage lies in the simplification of the valve construction, as the valve bodies can be made from a single piece, and thus a number of sites susceptible to vibration can be avoided.

A preferred embodiment of the invention will now be explained in more detail with reference to the accompanying drawing, the single view of which is an axial section through the combined stop and control valve structure.

The figure shows a section through the valve housing 1, the inlet and outlet branches of which have been omitted to illustrate more clearly the actual novel subject matter of the invention. The flow medium flows in the direction of arrow A into the valve housing 1 and first encounters a strainer 2, which is fitted at one end between housing cover 3 and valve housing 1, and at the other end between valve seat 4 and valve housing 1. The valve seat 4 forms the outer bounding surface of an annular diffusor, the inner portion of which serves as a bush 5 to guide the spindle 6 of the control valve 7. The end of the guide bush facing the control valve 7 has a mushroom-like head 8, its other end being fitted into the valve housing 1 to form a seal. Fitted in the housing cover 3 and in the inner portion 5 of the diffusor are bearings and seals for the spindles 6 and 19 passing through them of the control and stop valves 7 and 20, respectively. For reasons of clarity these bearings and seals are not shown or are not identified more closely.

The control valve 7 consists of the valve body 11 which contains the pilot valve 12 in the form of the spindle head. Located on the valve body 11 is the control edge 10 which, together with the seating surface 15 on the valve seat 4 (subsequently termed the main seat), forms the control aperture. On the inside of the sleeve-shaped valve body 11 there is a sliding surface 16 which, together with the conical outer contour of the head 8 of the guide bush 5, forms a conical guiding gap 35. This comprises the first axial guide for the valve body 11. In the closed position the pilot valve 12 bears on the seat 17 of the valve body 11. In any control position, however, the spindle head will engage the base 18 of the valve body and permit the continuous flow of working medium through holes 14 to seat 17. The spindle head has a sliding surface 16' on its outer circumference which provides the valve body 11 with its second means of axial guidance.

The fast-acting stop valve 20 is formed from the bell-shaped valve body 21 at the base 24 of which the pilot valve 22 is located on the end of spindle 19. Base 24 incorporates a flat seat 25 which engages a seat 26 on the housing cover 3 when the stop valve is open, to form a seal. The conical seat 27 on the housing-cover side of the pilot valve 22 is similarly closed by the latter to form a seal. The shear load on the valve body 21 is partially relieved by way of the conical seat 28 and the channels 29 with central bore 30. Fixed to the housing cover 3 is a guide bush 31 which bears on the outer circumference of the valve body 21 and provides axial guidance for the stop valve 20. In the closed position, the seat 23 of the stop valve 20 rests on valve seat 4, and thus prevents flow into the annular diffusor.

The operating principle will now be explained with reference to an opening procedure of the valve, the two valves 7 and 20 being initially closed. The stop valve 20 is opened by the movement of spindle 19, whereupon first the pilot valve 22 separates from seat 28 and engages seat 27. The working medium can then flow along channels 29 and through the central bore 30 into the space between the stop valve body 21 and control valve body 11. With the control valve 7 closed, this results in pressure equalization between the outer space and inner space of stop valve 20.

When a minimum pressure difference has been reached, the stop valve body 21 is raised until the flat seats 25, 26 block the flow of working medium to the gland of spindle 19 in the housing cover 3. At the same time, live steam pressure is admitted to the space inside the stop valve body 21. When seats 25, 26 and 22, 27 are sealed, the pressure in the space above base 24 decreases to atmospheric pressure owing to leakage along the spindle, and thus the live steam pressure forces the valve body 21 against the flat seat 25 of the housing cover 3. The control valve 7 has to be opened against full steam pressure. When the spindle 6 is actuated, the pilot valve 12 first opens seat 17. Owing to the pressure difference, however, the valve body 11 is still pressed against the seating surface 15 on valve seat 4. As travel of the pilot valve increases, the mass flow rises, and with it the pressure in cavity 34, until when the pilot valve stroke is complete the pressure attains more than 90% of the pressure at the inlet to the valve housing 1.

As spindle 6 is raised further, seat 10 of the control valve body lifts from the seating surface 15 of valve seat 4 and so the working medium can flow at a relatively high rate into the annular diffusor.

The quantity of steam which then flows through conical guiding gap 35 has a hydro-dynamic centering effect on valve body 11. Also, the axially directed flow at the outlet from gap 35 has the effect of deflecting the incoming mass flow passing over seating surface 15 into an axial direction, which helps the flow over the main seating to follow the outer contour of the diffusor.

I claim:

1. A combined stop and control valve for mounting in a pipe carrying the working medium of a turbo machine, of which the stop valve body and control valve body are arranged independently of each other in a common valve housing and with the stop valve body being located upstream of the control valve body when viewed in the direction of flow of the working medium through the combined valve, said stop and control valve bodies being provided with coaxial valve seats located next to each other and immediately adjacent a flow opening, said stop valve body being in the form of a bell into the hollow cavity of which said control valve body is inserted, pilot valves provided respectively for said stop and control valve bodies, at least one axial guide for the movement of said stop valve body, and axially spaced guides for said control valve body one of which is established by its pilot valve for providing sliding engagement for said control valve body throughout its valving movement.

2. A combined stop and control valve as defined in claim 1 wherein the pilot valve for said control valve includes a head slidable within and in contact with a complementary internal guide surface of the body of the control valve to establish one of said axial guides and a spindle slidable axially within and in contact with a guide bush which provides the other axial guide for the control valve body, the exterior surface of said guide bush also forming part of an annular diffusor structure.

3. A combined stop and control valve as defined in claim 2 wherein the end portion of said guide bush which faces said control valve body is expanded into a mushroom-shaped head having an outer contour of conical form which forms part of the surface of said diffusor structure.

* * * * *